US008289177B2

(12) United States Patent
Bohanon

(10) Patent No.: US 8,289,177 B2
(45) Date of Patent: Oct. 16, 2012

(54) CIRCUITRY TO MONITOR AND CONTROL SOURCE OF RADIANT ENERGY IN SMOKE DETECTOR

(75) Inventor: Mark C. Bohanon, Aurora, IL (US)

(73) Assignee: Honeywell International Inc., Morristown, NJ (US)

( * ) Notice: Subject to any disclaimer, the term of this patent is extended or adjusted under 35 U.S.C. 154(b) by 646 days.

(21) Appl. No.: 12/493,875

(22) Filed: Jun. 29, 2009

(65) Prior Publication Data

US 2010/0328085 A1 Dec. 30, 2010

(51) Int. Cl.
*G08B 17/10* (2006.01)

(52) U.S. Cl. ..... 340/630; 340/628; 356/338; 356/342; 250/573; 250/574

(58) Field of Classification Search ..... 340/630, 340/628; 356/338, 342; 250/573, 574
See application file for complete search history.

(56) References Cited

U.S. PATENT DOCUMENTS 4,185,278 A 1/1980 Lintelmann et al.
5,352,901 A * 10/1994 Poorman ..... 250/574
5,969,600 A * 10/1999 Tanguay ..... 340/438
6,166,648 A * 12/2000 Wiemeyer et al. ..... 340/630
2003/0001746 A1* 1/2003 Bernal et al. ..... 340/630
2005/0057366 A1 3/2005 Kadwell et al.
2007/0188337 A1* 8/2007 Mi et al. ..... 340/630
2008/0191888 A1* 8/2008 Penney ..... 340/630

FOREIGN PATENT DOCUMENTS

GB 1 321 016 6/1973

OTHER PUBLICATIONS

European Search Report corresponding to Application No. EP 10 16 7088, dated Oct. 25, 2010.

* cited by examiner

*Primary Examiner* — Jennifer Mehmood
*Assistant Examiner* — Hongmin Fan
(74) *Attorney, Agent, or Firm* — Husch Blackwell LLP

(57) ABSTRACT

A photo-electric smoke detector includes a source of radiant energy and a closed loop control circuit which responds to a radiant energy feedback signal to adjust an output characteristic of the emitted radiant energy and which evaluates a quality characteristic of the emitted radiant energy. The feedback circuit and the source can be intermittently activated. Emitted radiant energy is directed toward a lens. The feedback signal is proportional to radiant energy reflected or scattered off of the lens.

20 Claims, 1 Drawing Sheet

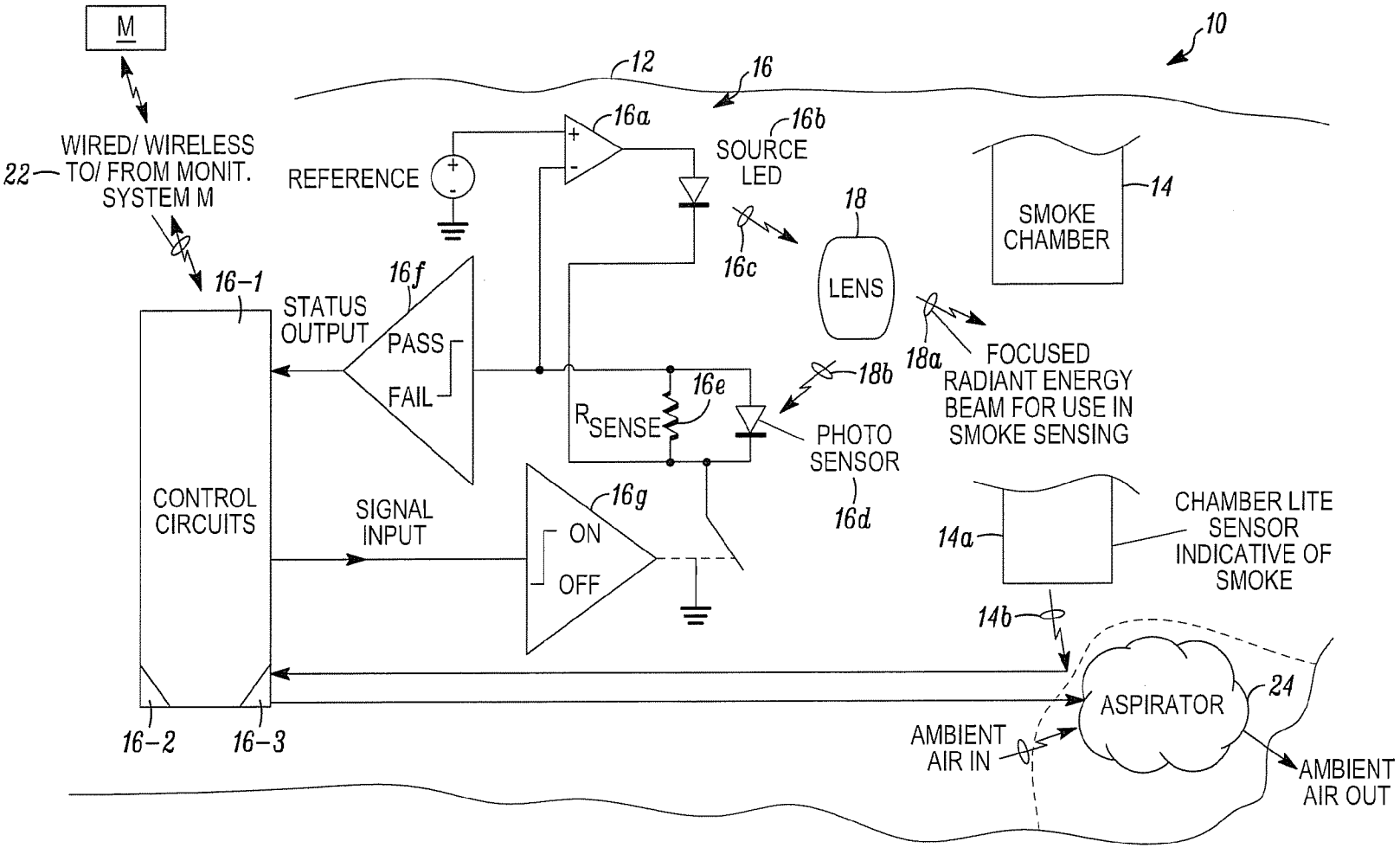
10
12
14
SMOKE CHAMBER
FOCUSED RADIANT ENERGY BEAM FOR USE IN SMOKE SENSING
18a
CHAMBER LITE SENSOR INDICATIVE OF SMOKE
14a
14b
24
ASPIRATOR
AMBIENT AIR OUT
AMBIENT AIR IN
16
18
LENS
18b
PHOTO SENSOR
16d
16b
SOURCE LED
16c
16e
$R_{SENSE}$
16a
16g
ON
OFF
REFERENCE
16f
PASS
FAIL
STATUS OUTPUT
SIGNAL INPUT
CONTROL CIRCUITS
16-1
16-2
16-3
M
WIRED/ WIRELESS TO/ FROM MONIT. SYSTEM M
22

CIRCUITRY TO MONITOR AND CONTROL SOURCE OF RADIANT ENERGY IN SMOKE DETECTOR

FIELD

The invention pertains to smoke detectors. More particularly, the invention pertains to aspirated smoke detectors where the source which injects radiant energy into the detector's smoke chamber can be monitored and controlled.

BACKGROUND

Photoelectric smoke detectors often include a mechanism to monitor an optical source which injects radiant energy into a smoke chamber of the detector. Photoelectric scattering smoke detectors often rely on a background quiescent level of optical measurement from the chamber to determine if source is operational. This is the result of light reflecting off many surfaces with the chamber and detected by a smoke sensing photo sensor. However, a very high sensitivity device, such as one having an aspirated smoke sensing chamber, may have little or no quiescent level at the respective photo sensor.

BRIEF DESCRIPTION OF THE DRAWING

FIG. 1 is a block diagram of a detector which embodies the invention.

DETAILED DESCRIPTION

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In an embodiment of the invention, monitoring of output of a source light emitting diode (LED) can be implemented by measuring reflected or scattered light from a lens that is used to focus the LED light into a smoke chamber. The reflected light can be used to both control the optical intensity of the LED and to provide feedback as to the LED's optical output intensity.

In one aspect, the drive circuit for the LED employs a photo diode to provide feedback. Some of the light from the LED is reflected off the lens. An optical sensor, such as a photo diode detects the reflected light. The current produced by the photo diode can be used to provide feedback to a driver amplifier for the LED to maintain the optical output power at a predetermined level.

In another aspect of the invention, the feedback circuit that is connected to the photo diode can also include a detection circuit. When feedback signal establishes that the LED amplifier is in its linear region of operation, the detection circuit provides an output indicative of the LED operating properly. When the feedback is no longer enough to maintain the LED amplifier within its linear region, the detection circuit provides an output indicative of the LED not working correctly (for example, burned out, degraded excessively). In response thereto, a maintenance or trouble signal can be generated.

In another aspect of the invention, an aspiration unit, a fan or blower for example, can be coupled to the detector's smoke chamber to inject fluid into or draw fluid from that chamber. That aspiration unit can be local to or remote the detector.

Control circuits can be coupled to the amplifier for the optical source, a sensor of reflected radiant energy therefrom and a smoke sensor associated with a sensing chamber of the respective detector. Such circuits could be implemented with one or more programmable processors and associated control software pre-stored on a computer storage medium.

FIG. 1 illustrates an embodiment 10 of the present invention. Detector 10 includes a housing 12 which carries a smoke chamber 14. Control circuits, generally indicated at 16 can also be carried by housing 12. It will be understood that the circuitry configuration of FIG. 1 is exemplary only. Other circuit configurations come within the spirit and scope of the invention.

Circuitry 16 includes an optical amplifier 16*a* which is coupled to a source light emitting diode 16*b*. Radiant energy 16*c* emitted by LED 16*b* is directed toward a lens 18. A focused portion 18*a* is directed into the smoke chamber 14 and used to detect a smoke concentration therein.

Various configurations of smoke chambers are known to those of skill in the art and do not represent a limitation of the present invention. An optical smoke sensor 14*a*, for example, a photo sensor, is coupled to chamber 14 and produces an electrical signal, on line 14*b* indicative of smoke concentration in chamber 14.

Radiant energy 18*b* reflected off of lens 18 is indicative of radiant energy output from LED 16*b* and is received by photo sensor 16*d*. Sensor 16*d* is coupled in parallel to a resistor 16*e*. A voltage generated across the sensor/resistor combination 16*d,e* can be fed back to amplifier 16*a* so as to adjust an electrical input parameter of source LED 16*b* and to maintain the source 16*b* operating in its linear range, assuming normal operation. That same voltage can be evaluated in a threshold establishing amplifier 16*f* to generate a binary output status signal.

A buffer amplifier 16*g* can be used to intermittently activate source 16*b* and sensor 16*d*. It will also be understood that at least some of the above noted circuit elements could be incorporated into additional control circuitry 16-1.

Control circuitry 16-1 could be implemented, at least in part, with one or more programmed processors 16-2 which execute control programs 16-3 pre-stored on a computer readable storage medium, for example EEPROM. Control circuitry 16-1 can also include a wired or wireless interface to communicate with a displaced monitoring system M via a medium 22.

Smoke indicating signals, on the line 14*b* can also be coupled to control circuits 16-1 for evaluation and transmission of indicia thereof to the monitoring system M. An aspirator 24 can be coupled to the smoke chamber 14, to inject ambient air into the chamber or to draw it from the chamber, all without limitation.

The aspirator 24 can operate under the control of circuits 16-1. It will be understood that aspirator 24 can be carried by housing 12, or, displaced from housing 12 all without limitation. Neither the exact characteristics of the aspirator 24 nor its location are limitations of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A smoke detector comprising:

a source which emits radiant energy;

a lens which focuses a first portion of the emitted radiant energy into a smoke chamber for use in detecting a smoke concentration therein and which reflects a second portion of the emitted radiant energy;

a sensor which senses the reflected second portion of the emitted radiant energy; and control circuits coupled to the source and sensor, responsive to sensor output, to adjust at least one source electrical input.

2. A detector as in claim 1 wherein the smoke chamber is located in a housing.

3. A detector as in claim 2 where the control circuits receive, from a smoke sensor associated with the chamber, a smoke indicating electrical signal.

4. A detector as in claim 3 where the control circuits activate, at least intermittently, the sensor of reflected radiant energy.

5. A detector as in claim 4 where the control circuits adjust the at least one source electrical input in accordance with a predetermined criterion.

6. A detector as in claim 5 where the control circuits activate the source, at least intermittently.

7. A detector as in claim 5 which includes an aspirator that provides a fluid flow for the smoke detector.

8. A detector as in claim 5 which includes additional circuitry, coupled to the sensor, which monitors source output.

9. A detector as in claim 1 which includes additional circuitry, coupled to the sensor, which monitors source output.

10. A detector as in claim 1 where the control circuits include a circuit, responsive to the sensor, to provide both radiant energy output indicating feedback and to adjust the at least one source electrical input.

11. A smoke detector which comprises:

a housing which carries at least:

a smoke chamber;

an optical sensor which emits an electrical signal indicative of smoke in the chamber;

a lens positioned to direct a first portion of incident radiant energy, at least in part, into the chamber for use in detecting a smoke concentration therein and to reflect a second portion of the incident radiant energy; and monitoring circuits which compare the reflected second portion of the incident radiant energy to a predetermined standard and which, responsive thereto, generate a performance indicating signal.

12. A detector as in claim 11 which includes a source of radiant energy incident on the lens.

13. A detector as in claim 12 where the monitoring circuits adjust an electrical input parameter of the source of radiant energy.

14. A detector as in claim 13 which includes control circuits coupled to the optical sensor and the monitoring circuits, the control circuits, responsive to the optical sensor, establish the presence of an alarm condition.

15. A detector as in claim 13 where the monitoring circuits include at least one programmable processor and associated control software, pre-stored on a computer readable storage medium, and the processor and executed software, responsive to the optical sensor, establish the presence of an alarm condition.

16. A detector as in claim 13 which include at least one programmable processor and associated control software, pre-stored on a computer readable storage medium, and the processor and executed software, responsive to the optical sensor, establish a smoke concentration message and forwards that message to a displaced monitoring system.

17. A detector as in claim 16 which includes an input/output interface to forward that message to a displaced monitoring system.

18. A detector as in claim 11 which includes an aspirator.

19. A detector as in claim 18 where the aspirator is coupled to the smoke chamber for one of drawing ambient fluid from the chamber or injecting ambient fluid into the chamber.

20. A photo-electric smoke detector comprises:

a source which emits radiant energy and a closed loop control circuit which responds to a radiant energy feedback signal to adjust an output characteristic of the emitted radiant energy and which evaluates a quality characteristic of the emitted radiant energy; and a lens where emitted radiant energy is directed toward the lens, where a first portion of the emitted radiant energy is focused by the lens into a smoke chamber for use in detecting a smoke concentration therein, and where a second portion of the emitted radiant energy is reflected by the lens so that the radiant energy feedback signal is proportional to the reflected second portion of the emitted radiant energy.

* * * * *